US006379064B1

(12) United States Patent
Giles et al.

(10) Patent No.: US 6,379,064 B1
(45) Date of Patent: Apr. 30, 2002

(54) PRINTER CHASSIS CONSTRUCTION

(75) Inventors: Robert Giles, Escondido, CA (US); Jordi Gimenez, Rubí Barcelona (ES); Rajan Ramaswamy, Sant Cugat Barcelona (ES); Emilio Angulo, Barcelona (ES); Fernando Juan, Viladecavalls Barcelona (ES); Ventura Caamano, Sant Joan Despi Barcelona (ES); Richard H Lewis, Santa Maria de Palautordera Barcelona (ES); Antoni Monclus, Castelldelfels Cugat Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/504,049

(22) Filed: Feb. 14, 2000

(30) Foreign Application Priority Data

Feb. 17, 1999 (EP) ..... 99301172

(51) Int. Cl.[7] ..... B41J 2/325

(52) U.S. Cl. ..... 400/691; 400/691; 400/693; 400/352; 400/354; 400/354.3

(58) Field of Search ..... 400/691, 693, 400/352, 353, 354–354.3; 347/108, 152

(56) References Cited

U.S. PATENT DOCUMENTS

| | | | | |
|---|---|---|---|---|
| 4,145,145 A | | 3/1979 | Haubrich et al. | 400/124 |
| 4,944,621 A | | 7/1990 | Uecker | 400/691 |
| 5,195,836 A | | 3/1993 | Longust et al. | 400/354 |
| 5,413,427 A | * | 5/1995 | Giles et al. | 400/691 |
| 5,600,360 A | | 2/1997 | Lerner et al. | 347/171 |
| 5,775,825 A | * | 7/1998 | Hong et al. | 400/693 |
| 6,203,224 B1 | * | 3/2001 | Kerr | 400/694 |

FOREIGN PATENT DOCUMENTS

| | | |
|---|---|---|
| FR | 2 539 354 | 1/1983 |
| FR | 2 623 902 | 11/1987 |
| GB | 2191150 A | 12/1987 |

OTHER PUBLICATIONS

European Search Report, Sep. 14, 1999, re European Patent Application EP 99301172.

Partial European Search Report, Jul. 8, 1999, re European Patent Application EP 99301172.

IBX Tchnical Disclosure Bulletin, vol. 25, No. 5, Oct. 1982 (1982–10), pp. 2661–2663 [XP–002104625] .

* cited by examiner

*Primary Examiner*—John S. Hilten
*Assistant Examiner*—Kevin D. Williams

(57) ABSTRACT

To assemble a printer chassis comprising three structural aluminium beams extending between two structural sideplates, the printer carriage beam is first attached to the sideplates by means of attachment points arranged along a straight line and then the printing beam and lower beam are attached to provide a vibration- and deformation-resistant chassis relative to which all the other printer components are referenced. Slider rods are mounted on the printer carriage beam by means of screws which hold the rods against the beam to keep them straight. The screws also pass through apertures in rod supports, the apertures being sized to permit longitudinal thermal movements of the rods relative to the beam.

27 Claims, 9 Drawing Sheets

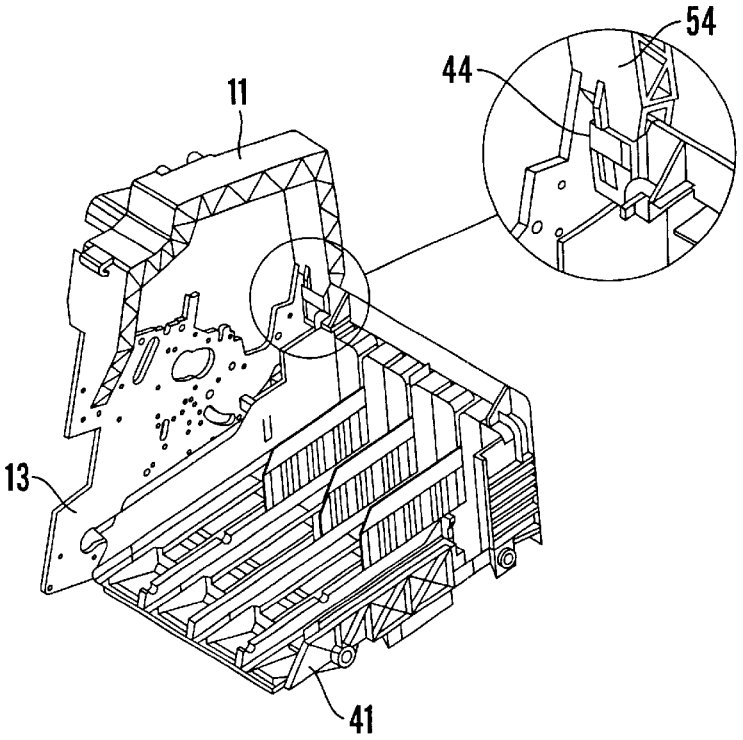
Fig. 15a
Fig. 15
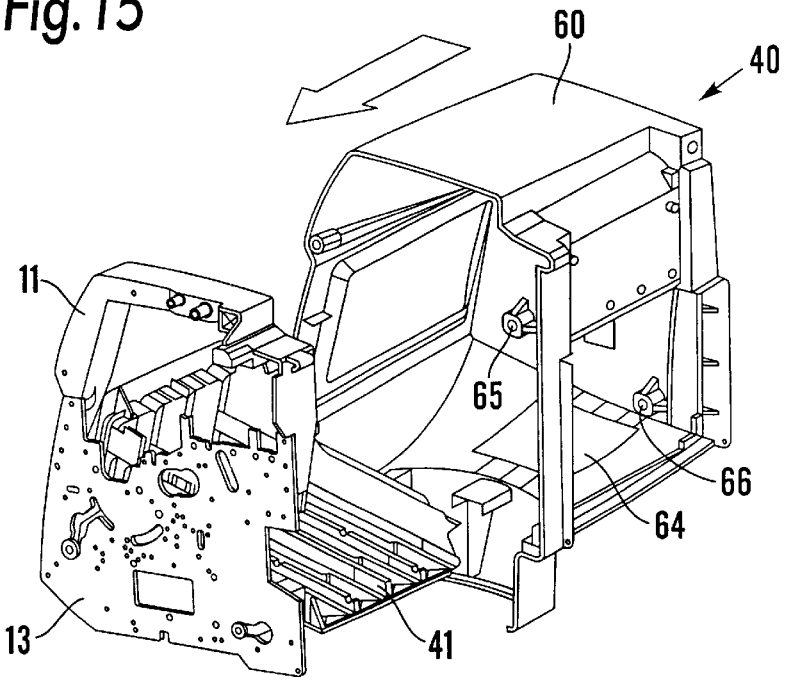
Fig. 16

PRINTER CHASSIS CONSTRUCTION

BACKGROUND OF THE INVENTION

The present invention relates to the construction of printers, especially large format printers, and more particularly to the printer chassis and to the arrangement of the other printer components therein.

When constructing a printer, conflicting design constraints arise. A robust structure is required so that the printer can withstand the considerable dynamic forces which arise in use. Furthermore, unwanted vibrations or movements can cause a deterioration of print quality. On the other hand, certain components require to be precisely located and possibly adjusted during use. The problems are particularly acute in large format printers, in which the support points for components such as beams can be a considerable distance apart.

In some prior art printers, cover members constitute structural members, but this restricts the aesthetic design of the printer, adds weight to the printer, and requires the covers to be attached when testing the printer. In U.S. Pat. No. 5,195,836, the printer chassis comprises as its main structural member a rigid support beam which is connected at its ends to two parallel structural sideplates. The sideplates provide cradles for the printer carriage slider rods. These rods are precisely positioned by a system of yoke members which are connected to the main support beam and are supported at openings in the sideplates. The sideplates are allowed to flex in the longitudinal direction of the rods, e.g. under the effects of temperature, so as not to affect the vertical position or straightness of the rods.

U.S. Pat. No. 5,600,360 discloses a frame for mounting a printer carriage with upper and lower beams having their ends directly connected to sideplate members. French Patent 2539354 discloses a printer with beams, each beam having its own sideplates.

SUMMARY OF THE INVENTION

The present invention seeks to provide a relatively simple printer chassis construction which is robust and permits precise location of components where required, and yet provides wide design flexibility, e.g. in terms of the positioning and attachment of the other components of the printer, such as the ink supply system, and in the nature and functioning of cover members of the printer.

According to a first aspect of the present invention there is provided a printer chassis comprising a first structural beam with means to support a printer carriage, and two structural sideplate members arranged to be attached to said first beam, wherein said first beam is directly attached to each said sideplate member such that said sideplate members are spaced from the ends of said first beam so that it extends at both ends beyond said sideplate members, and the chassis comprises one or more further structural beams of the same material as said first beam and extending between said sideplate members.

The term "structural" means that the members concerned support the weight and/or control the deformations of other parts of the system.

Preferably, said first beam is attached to each sideplate member by means of a plurality of attachment points which extend in a straight line. Such a connection acts as a type of hinge which protects the first beam from the adverse effects of deformations of the sideplate members, both during attachment of the further structural beams and during subsequent use of the printer.

Preferably each beam comprises a plurality of channels of at least part-circular cross-section which are arranged to align with corresponding apertures in the sideplate members to define self-tapping screw connections. This enables the beams to be produced by an extrusion method, without the need for special machining steps at the attachment points.

Preferably the printer carriage support means support slider rod means for the printer carriage which are secured to the support means at spaced intervals in the longitudinal direction by securing members which in a first region restrict relative movement in all directions and which, in at least one second region, permit limited relative movement in the longitudinal direction but restrict relative movement in the two mutually-orthogonal directions. This enables differential thermal movements to occur in the longitudinal direction, between the slider rod means (preferably steel) and the beam (preferably aluminium), without affecting the straightness of the slider rod means and their location relative to the sideplate members.

Preferably, the securing members have shaft portions which extend through apertures in the support means and openings in the slider rod means, and the apertures in a first region of the support means are of substantially the same size as the openings in the slider rod means whereas the apertures in at least one second region of the support means are of increased size in the longitudinal direction. The securing members are preferably threaded screws.

The securing members may be provided with resilient biasing means to control the securing force e between the slider rod means and said first beam. The securing force is substantially constant within a predetermined narrow range. The resilient biasing means are preferably helical springs around the shaft portions of the securing members. Without the springs it would not be feasible to obtain or maintain the constant force.

In preferred arrangements each sideplate member defines a respective seating for each of two slider rods, one of said seatings comprising a V-shaped groove, and the other of said seatings comprising a flat support surface. This enables the V-shaped groove to precisely reference the relative positions of the sideplate members to the slide rod which is in the groove (and thus to the printer carriage beam), whereas the flat surface supports the other slider rod in the vertical direction, but without over-specifying its location in the front/rear direction.

A printer apparatus may comprise a printer chassis as defined above together with at least one printer sub-unit having a plurality of projecting attachment elements, wherein the sidepalte members are provided with a plurality of apertures which are arranged to receive the projecting attachment elements. The projecting attachment elements preferably comprise stud and/or clip members and the arrangement is such that the sub-units can be readily and quickly attached to the printer chassis and subsequently detached therefrom.

According to a second aspect of the present invention, there is provided a method of assembling a chassis for a printer comprising a first structural beam, two structural sideplate members and one or more further structural beams of the same material as said first structural beam, wherein said first beam is firmly, precisely and directly fixed to each said sideplate member such that said sideplate members are spaced from the ends of said first beam and so as to define a reference for the relative location of the or each said further structural beam between said sideplate members.

Such a method provides a structure which is resistant to vibrations and deformations so as to permit a high printing quality.

According to a third aspect of the present invention there is provided printer apparatus comprising a printer carriage beam having elongate support means arranged to support at least one slider rod for mounting a printer carriage, wherein said rod and said beam are secured together at spaced intervals in the longitudinal direction by securing members wherein, in a first region, said securing members restrict relative movement in all directions and which, in at least one second region, said securing members permit limited relative movement in the longitudinal direction but restrict relative movement in the two mutually-orthogonal directions.

Such a printer apparatus has the previously-mentioned advantages.

BRIEF DESCRIPTION OF THE DRAWINGS

Preferred embodiments of the invention will now be described, by way of example only, with reference to the accompanying drawings, of which:

FIGS. 15 and 15*a* show the assembly of the ink supply station to an arc member of the printer chassis of FIG. 1 (FIG. 15*a* being on an enlarged scale); and FIG. 16 shows the mounting of a cover for the ink supply station, the cover being shown partly-sectional.

DESCRIPTION OF THE PREFERRED EMBODIMENTS

Figure 1:
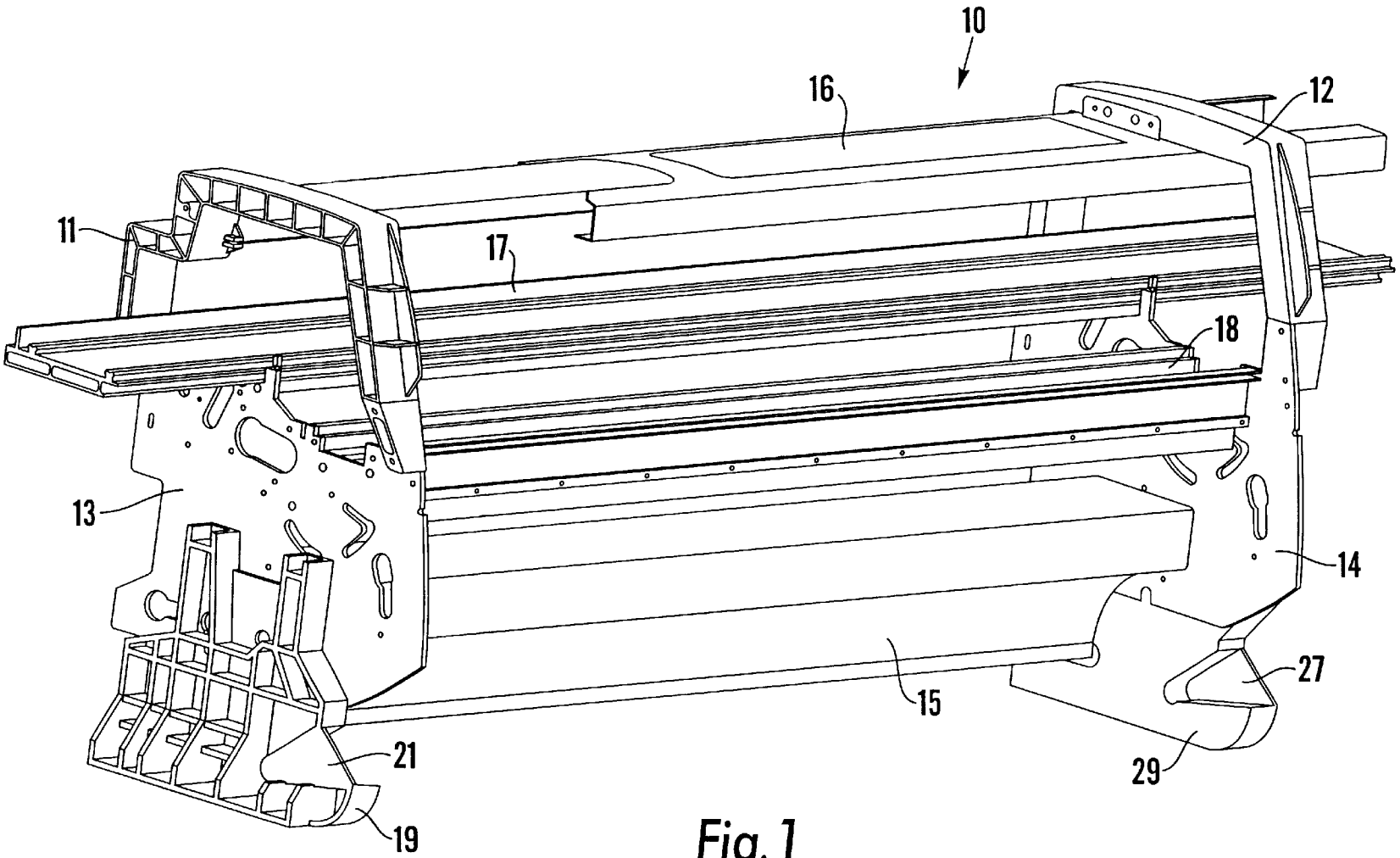
FIG. 1 shows a front perspective view of the configuration of a printer chassis in accordance with the present invention.
Figure 2:
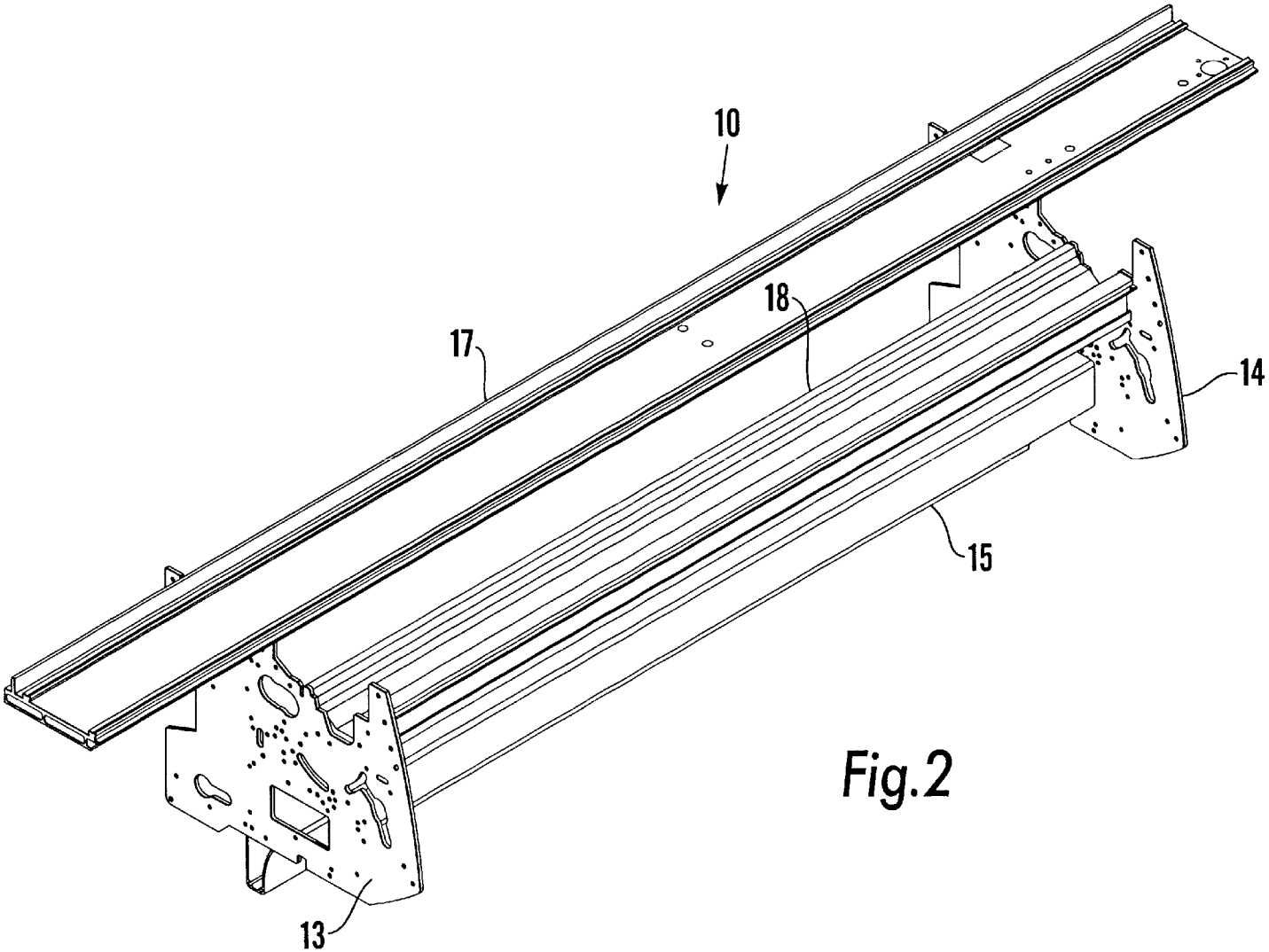
FIG. 2 shows a front perspective view on a smaller scale, showing the structural beams and sideplate members only.
Figure 3:
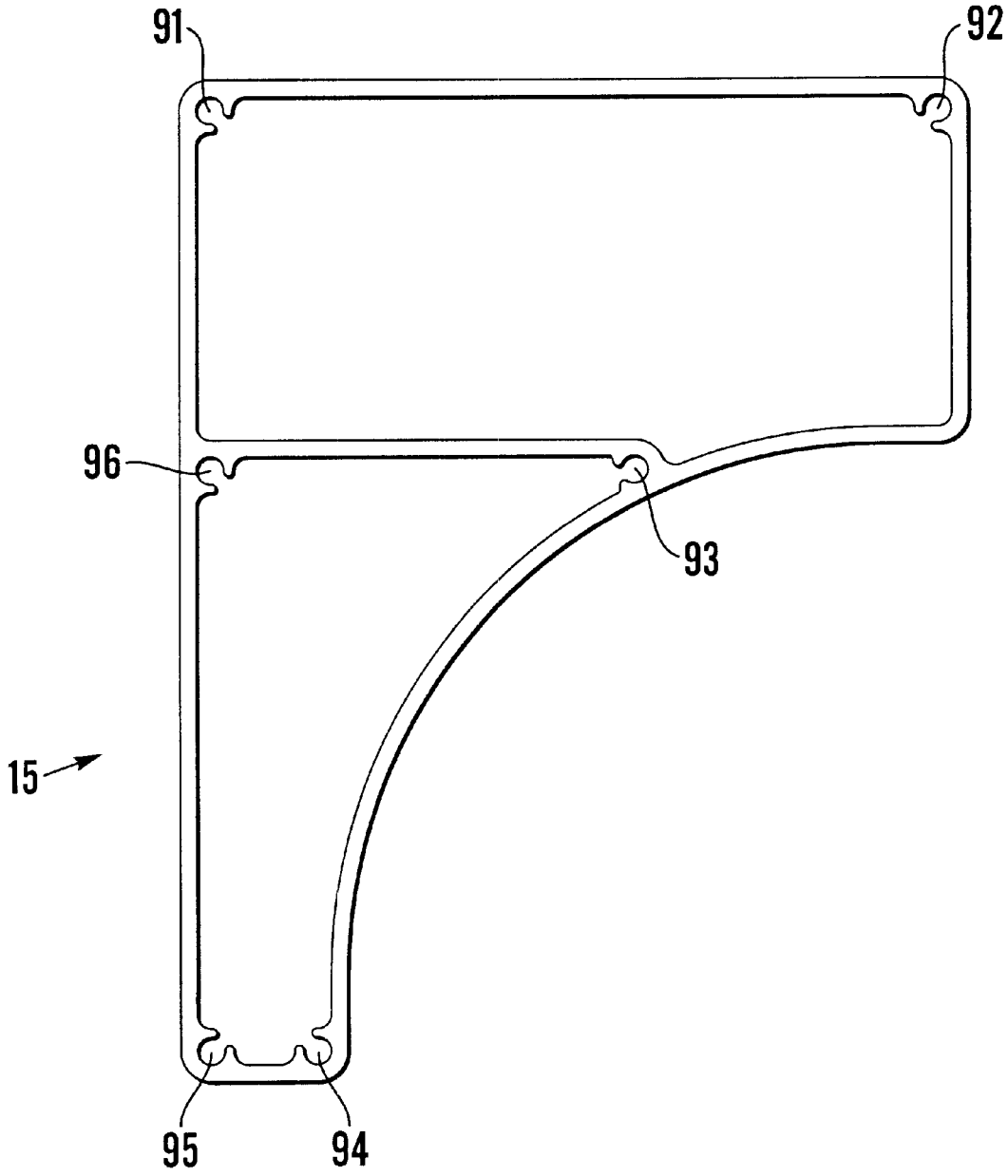
FIG. 3 shows a cross-sectional view on a larger scale of a lower structural beam.

Referring now to the drawings, a printer chassis 10 comprises three structural beams 17, 18 and 15 which are all of extruded aluminium and which extend between structural sideplate members 13, 14, which are of stamped aluminium sheet material.

Figure 4:
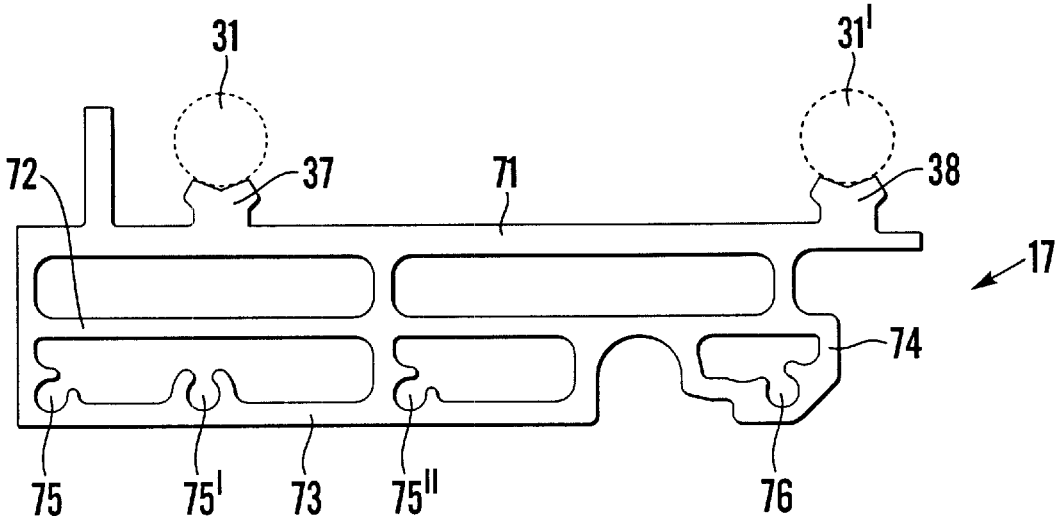
FIG. 4 shows a cross-sectional view of a printer carriage support beam at a central region thereof.

Beam 17 is the printer carriage beam and has bushing supports 38, 37 FIG. 4 for locating front and rear precision steel rods 31, 31$^1$ upon which travels the printer carriage. Each bushing support has a generally V-shaped cross-section which serves to precisely locate the respective steel rod relative to the beam 17.

Figure 8:
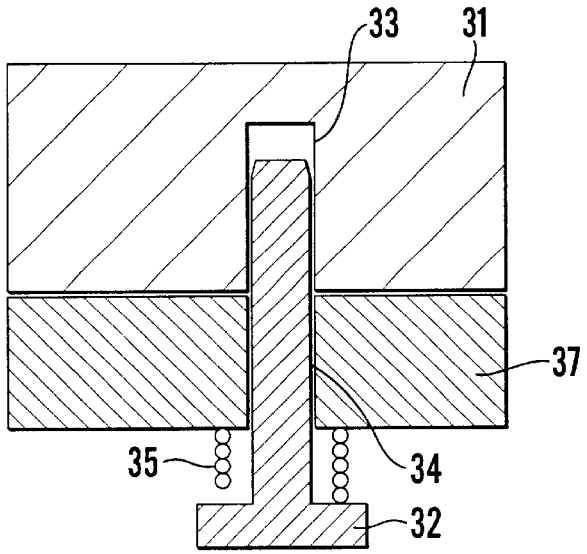
FIG. 8 schematically shows, on an enlarged scale, the attachment of a slider rod to the central region of the printer carriage support beam.
Figure 9:
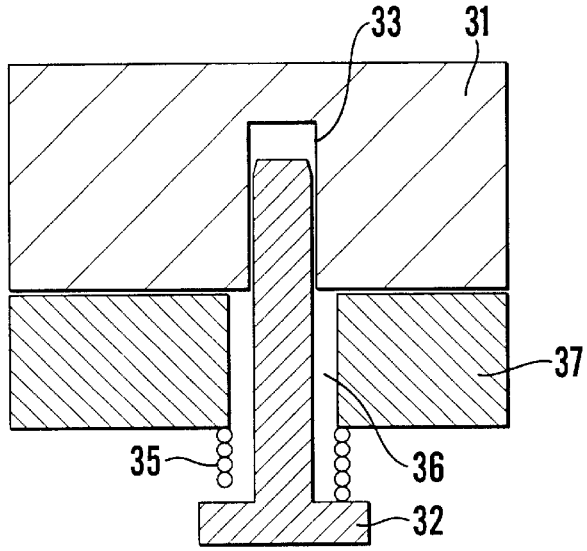
FIG. 9 similarly shows the attachment at an end region of the printer carriage support beam.

Because the steel rods are not precisely straight in practice, it is necessary to provide means to straighten them by holding them firmly against the precisely-shaped beam 17. Although this also serves to restrict longitudinal movement of the rods, it must allow them to undertake differential thermal expansion and contraction movements in the longitudinal direction. To satisfy this requirement, the steel rod 31, FIGS. 8 and 9, is attached at spaced intervals to the support 37 by means of shoulder screws 32 which enter into threaded holes 33 in the rod. Helical springs 35 are provided around the shafts of the screws to define a preload system. At the centre of the rod 31 and beam 17, the aperture 34, FIG. 8, in the support 37 is essentially circular and of the same diameter as the hole 33; this achieves firm and accurate location. Towards the ends of rod 31 and beam 17, however, the aperture 36, FIG. 9, in the support 37 is elongated; this permits the rod 31 to make thermal movements along the length of the beam (i.e. to the left and right in FIG. 9) while accurately positioning the rod in the orthogonal directions, which are important for print quality.

In the preferred embodiment, there are two apertures 34 located adjacent to the centre of rod 31, with three apertures 36 spaced along the rod at each side, making eight in all. The other steel rod 31$^1$ is attached to support 38 in a similar fashion.

As shown in FIG. 4, the central region of beam 17 has a cross-section with three main horizontal limbs 71, 72, 73, and an additional portion 74 aligned with bottom limb 73. Limb 73 incorporates three channels 75, 75$^1$, 75$^{11}$ of incomplete circular cross-sectional shape and portion 74 has a similar channel 76. The channels 75, 75$^1$, 75$^{11}$ and 76 are arranged in a straight line. Preferably, the cross-sectional shape of each channel 75, 75$^1$, 75$^{11}$ 76 defines just over three quarters of a complete circle.

Figure 10:
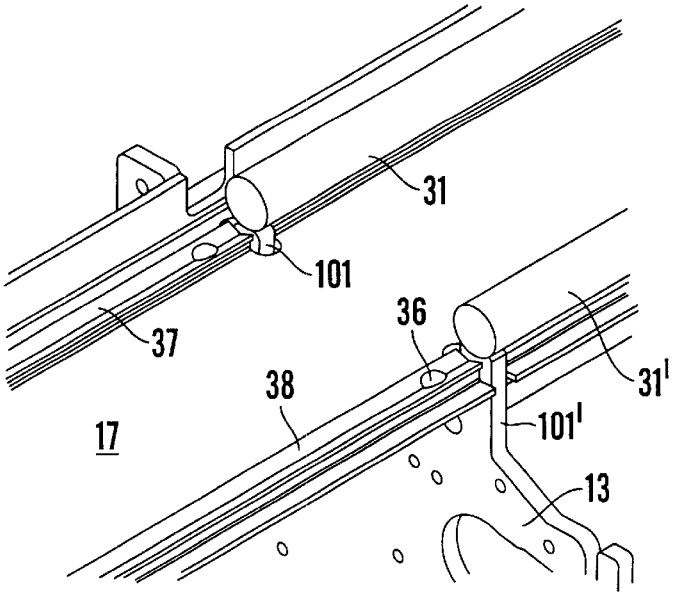
FIG. 10 shows a perspective view of the location of the slider rods relative to a sideplate member, with the slider rods partially sectioned.

Limb 73 and portion 74 are omitted at both end regions of the beam 17, i.e. where the beam projects beyond the sideplate members 13, 14. This enables the sideplate members to abut against the shoulders formed at the junctions between the central and end regions of the beam 17, see FIG. 10.

Figure 5:
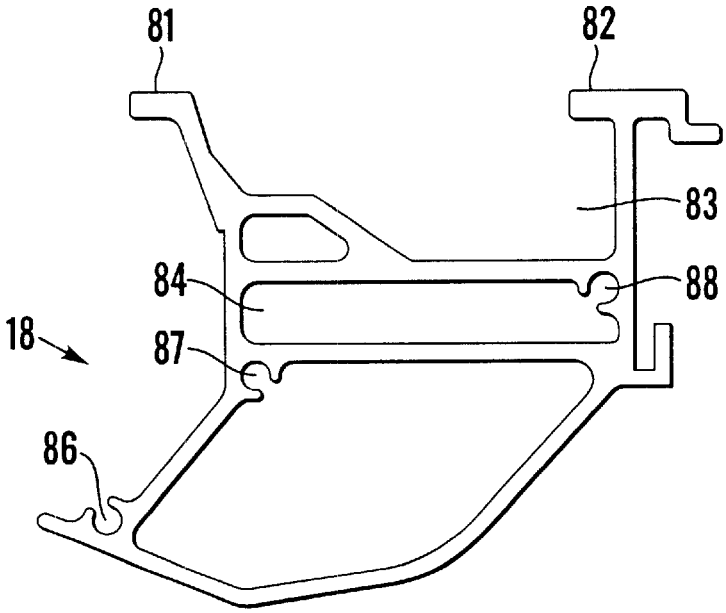
FIG. 5 shows a cross-sectional view of a paper drive and printing beam.
Figure 6:
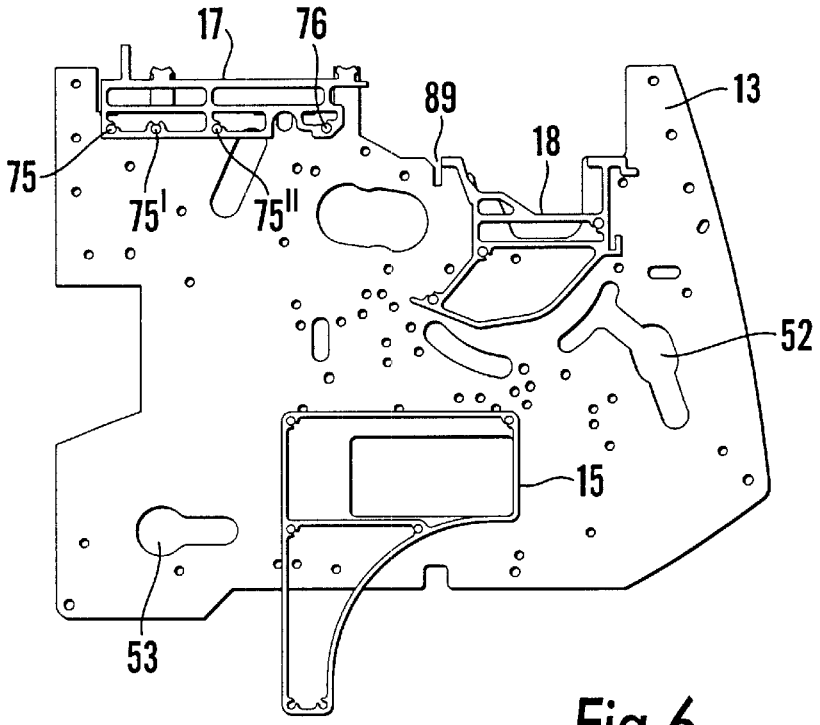
FIG. 6 shows a side view of the left hand sideplate member, illustrating the positions of the beams.
Figure 7:
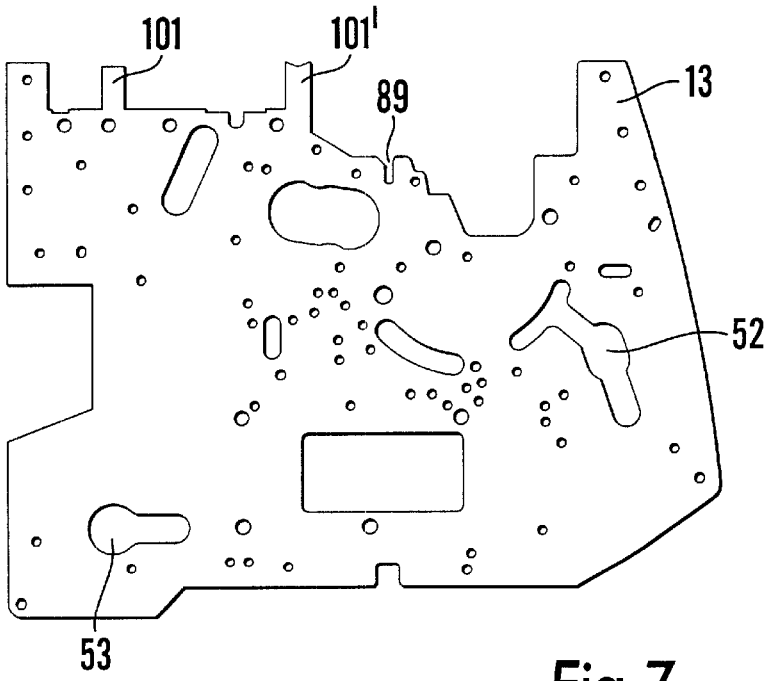
FIG. 7 shows a view corresponding to FIG. 6 without the beams.

Beam 18 is the printing beam of which top precision surfaces 81, 82 are arranged to support a plastics apertures plate (not shown) over which travels the paper to be printed. With the plate in position, passages 83, 84 within beam 18 constitute vacuum channels for causing paper to be closely held against the plate. The main paper drive roller (not shown) is arranged to be located to the left of beam 18 as shown in FIG. 5, and passage 83 is arranged to accommodate an overdrive roller (not shown). Beam 18 also has incomplete circular channels 86, 87 and 88.

Beam 15 is the lower beam which has a relatively large cross-section, thus providing high bending and torsional stiffness in addition to strength. Thus beam 15 allows beams 17 and 18 to be slimmer than in existing printers. Beam 15 also has incomplete circular channels 91–96. Beams 18 and 15 are of uniform cross-section throughout.

Securely attached, e.g. by screws, to and extending upwardly from the tops of the sideplate members 13, 14 are respective structural arc members 11, 12. Securely attached, e.g. by screws, to and extending between the arc members is an upper beam in the form of an ink tube guide and support member 16, FIG. 1, which may also be at least partly structural in that it serves to tie the two arc members 11, 12 together. The arc members also serve to support cosmetic (i.e. non-structural) covers for the printer (not shown) and a window. Together the arc members 11, 12 and beam 16 serve to protect the print zone in that they enclose the region in which the printer carriage travels.

Securely screwed to the bottom of sideplate members 13, 14 and to beam 15, by means of channels 94, 95, are respective support members 19, 29, FIG. 1, of injection moulded plastics material which serve to accurately position and support the rollfeed paper spindle and associated hardware and to interface with a stand (not shown). Tapered slots 21, 27 serve to support the ends of a paper roll which may be fed via a corresponding paper path to the printing surface. The printer provides a dual paper path arrangement, and in an alternative mode cut sheets of paper are fed from a separate supply (not shown) straight through the printer via a corresponding paper path.

During manufacture of the printer chassis 10, its various components are oriented on a dedicated assembly tool prior to the insertion of screws which hold the chassis assembly together. This process allows the various pieces of the chassis assembly to be joined while at the same time maintaining good dimensional tolerances between the pieces. The assembly sequence used for the chassis is optimised to minimise mechanical distortions of the critical chassis components.

During assembly, the rods 31, 31$^1$ are attached to supports 37 and 38 respectively and the screws 32 are fully tightened so that the rods are truly straight. Finger portions 101, 101$^1$ of the sideplate members 13, 14 are then positioned against the rods, FIG. 10, and held there by pneumatically-operated pistons of the assembly tool. Finger portion 101 has a flat, horizontal top surface, whereas finger portion 101$^1$ has a V-shaped groove. This arrangement serves to precisely locate the sideplate members relative to the rods, as follows. The V-shaped grooves provide firm and accurate seatings for the rods in that there is contact along a single line at each side between the cylindrical surface of a rod and the flat side of the groove. Once slider rod 31$^1$ has been precisely located in the groove of finger portion 101$^1$, there is no further need to specify the position of slider rod 31 in the forwards/backwards direction and this is why finger portion 101 is flat, so that it specifies the position of rod 31 only in the vertical direction.

With the sideplate members 13, 14 being held in position relative to the rods 31, 31$^1$ and thus beam 17, the ends of channels or bosses 75, 75$^1$, 75$^{11}$ 76 are aligned with corresponding openings in the sideplate members 13, 14 and attached by means of screws in a self-threading manner. Since the channels are arranged in straight lines, the screw connection at each end acts in the manner of a hinge. These connections enable any deformation in the sideplate members to be taken up without affecting the accuracy of the printer.

The attachment of beam 17 serves to locate the sideplate members 13, 14 for the subsequent assembly of beams 18 and 15. The ends of channels 86, 87 and 88 of beam 18 are aligned with corresponding openings in the sideplate members and attached by means of self-threading screws. The initial alignment of beam 18 is achieved as follows. In practice, beam 18 is provided as a sub-assembly with the plastics vacuum plate already attached thereto. The plastics plate has a tongue projecting therefrom and, during this stage of the manufacture of the chassis 10, a piston of the assembly tool pushes the tongue against the edge of a slot 89 provided in each sideplate member. The aligned beam 18 and sideplate members 13, 14 are then screwed together.

Beam 15 is then similarly attached by means of channels 91, 92, 93 and 96 to complete a rigid chassis structure 10. The beams are attached in the order of the precision required, and the attachment of each beam does not adversely affect the accuracy of the attachment of any previously-attached beams. In particular, the hinge-type screw connection of beam 17 maintains accurate location of the slider rods even though beam 17 is the first beam to be attached to the sideplate members 13, 14. Beam 16 and the other components are then assembled.

Shipping the printer from the factory to the customer can subject the printer and its package to very high loads, primarily due to the dropping of the package during shipping. The product is shipped upside-down in the package without the stand mounted. This orientation aids in the set-up of the product at the customer site but imposes high loads on the traditionally weak top face of the product. The printer chassis 10 with the arc and tube guide structures exhibits good top face loading resistance. The chassis is designed to be loaded by the packaging in specific areas. This allows the shipping loads to transfer through the packaging with some attenuation and then pass directly into the chassis itself. This transfer of shipping loads through the package directly to the product chassis occurs on all six package faces.

The above-described arrangement has several advantages. Because the three main beams 15, 17, 18 which define the rigidity of the chassis 10 are all of aluminium, problems due to differential thermal expansion are avoided. In addition aluminium extrusions and stampings are relatively inexpensive to produce. After production of an aluminium extension, precise machining may be performed thereon at locations where accuracy is required. The hinge-type connection arrangement of beam 17 prevents the rest of the chassis from putting a bending moment on this beam, which would adversely affect the tolerances required for high quality printing. The connection arrangement also allows beam 17 to be longer than beams 15 and 18 which permits a more compact printer housing. Once assembled, the beams 15, 17, 18 provide numerous precise reference points for locating the remaining printer components. In particular beam 18 provides references for stably supporting a flat print plate permitting wide band printing. After manufacture, there is no further need for adjustment for tolerances. Manufacturing tolerances affecting the lengths of the beams are accommodated when the chassis assembly is assembled and screwed together by the flexibility the sideplate members exhibit in a direction perpendicular to their planes. The chassis can efficiently absorb mechanical shock and vibration loads both during transportation and subsequent use.

The chassis construction also permits the simultaneous provision of a dual paper path printer, an ink delivery system with supply tubes, and a substantially non-structural design, i.e. compact and slender beams 17 and 18 can be employed, and the cover members can be sleeker and there is more freedom in their design. The robust nature of the chassis permits the support members 19, 29 to be mounted on a simple and cheap stand, which can be assembled by a customer. Any floor irregularities beneath the stand have a minimal effect.

Since the slider rods 31 are referenced only to beam 17, their straightness is not affected by any deformations of the sideplate members. Longitudinal thermal movements are permitted, but the location of the rods 31 in the vertical direction is restricted by the force of the springs around screws 32.

Various modifications may be made to the above-described arrangement. For example, beam 17 and/or 18 may be made more robust, with beam 15 being omitted, but this limits the design flexibility of beams 17 and 18. Alternatively, beam 15 may be incorporated into a stand for the printer, but in practice this may require the other beams to be made more robust. In another modification, the structural arc members 11, 12 may be omitted, in which case the functions of the upper beam 16 may be incorporated into beam 17.

The front and rear finger portions 101, 101[1] may be interchanged so that finger portion 101 has the V-section and finger portion 101[1] flat. Also, each rod may have one or more circular bores 34 to provide secure attachment at the centre. In another modification the region of the support 37 with circular apertures 34 may be displaced towards one end of the beam 17 and the other apertures 36 may become progressively more elongated towards the other end of the beam 17. However, the previously-described embodiment has the advantage of symmetry. Screws 32 may be replaced by threaded bolts fixed to and projecting from the rod 31 at spaced intervals and secured to the support 37 by nuts.

In a further development of the invention, printheads mounted on the printer carriage are continuously supplied with ink via flexible supply tubes connected to an ink supply station 40 which is supported on the left sideplate 13. The ink supply tubes are guided and supported by the beam 16 and arc member 11 as the printhead moves to and fro. A printhead service station (not shown) is supported on the right sideplate 14 with facilities for wiping, cleaning and capping the printheads. The sideplates 13, 14 are provided with a suitable number of suitably-shaped holes to enable the ink supply station and the printhead service station to be realisably but securely attached thereto.

Figure 11:
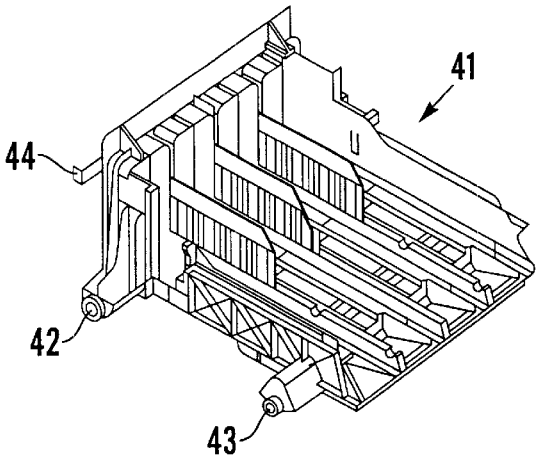
FIG. 11 shows a rear perspective view of an ink supply station for attachment to the printer chassis.
Figure 12:
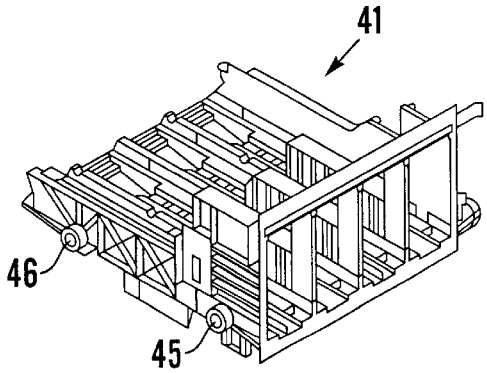
FIG. 12 shows a front perspective view of the ink supply station of FIG. 11 from the opposite side.
Figure 13:
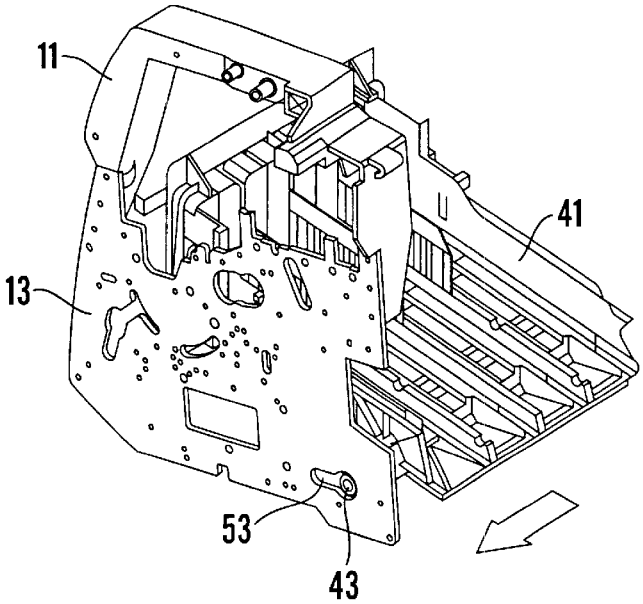
FIG. 13 shows a rear perspective view of the assembly of the ink supply station of FIGS. 11 and 12 to the left-hand sideplate member of FIG. 1.
Figure 14:
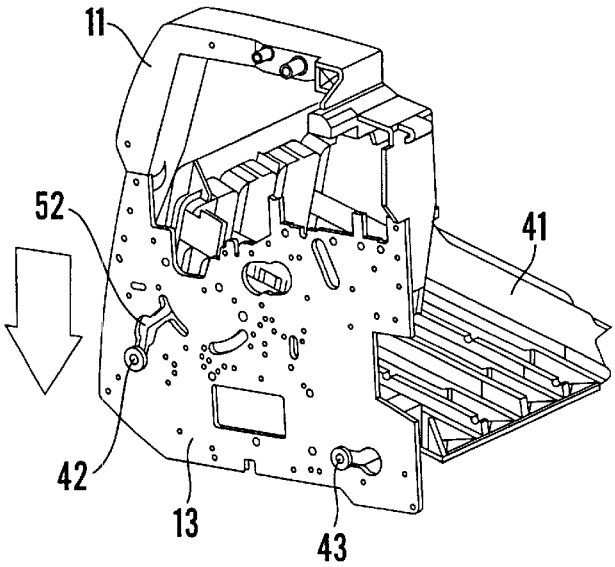
FIG. 14 shows an assembly stage subsequent to FIG. 13.

There will now be described with reference to FIGS. 11 to 16 the assembly of the ink supply station 40 to the sideplate member 13. FIGS. 11 and 12 show the housing part 41 of the ink supply station which is of plastics material and containing the ink supply cartridges connected to the ink supply tubes. At one side, part 41 has front and rear connecting members 42, 43 in the form of stud projections with a peripheral groove spaced from the end thereof. Above connecting member 42, the part 41 has a clip 44. On its other side, part 41 has front and rear clip members 45, 46.

To assemble the housing part 41 to sideplate member 13, connecting member 43 is introduced into the wide end of a keyhole slot 53 and then slid into the narrow end so that the edges of the narrow end engage in the peripheral groove of member 43. The part 41 is then rotated so that connecting member 42 is aligned with the wide part of a corresponding slot 52 in the sideplate member 13. Member 42 is then introduced into the slot 52 and then part 41 is rotated so that member 42 enters the narrow end of the slot, with the edges thereof engaging the peripheral groove of member 42.

The housing part 41 is then connected to the arc member 11 by means of clip 44 engaging a complementary formation 54 (see FIG. 15*a*) on member 11. This assists in retaining the part 41 on the sideplate member 13 and in particular serves to fix vertically the connection between member 42 and slot 52. In this configuration, the part 41 is securely supported by the sideplate member 13 and the ink supply station can be fitted out and tested.

However, for use, the ink supply station is supplied with a cover 60, FIG. 16 which has internal front and rear mounting boxes 65, 66. The cover has an internal ramp portion 64 at the bottom leading up to the boxes 65, 66. Cover 60 is positioned over the part 41, see FIG. 16 and clip members 45, 46 enter and are secured apertures defined in boxes 65, 66 the ramp portion 64 assisting in this. Thus the housing part 41 serves to secure the cover 60 to the sideplate member 13. No screws are needed so that the whole station 40 is easy to attach to and detach from the printer chassis.

A printhead service station or other printer sub-unit may be mounted in a similar fashion on the right hand sideplate member 14.

It will be appreciated that the printer chassis construction according to the present invention provides a combination of structural and precision functions. For example, precise location can be achieved by using the slider rods themselves to position the first beam relative to the sideplate members while the first beam and the sideplate members are being interconnected. This is not possible in prior art arrangements in which the sideplate members define the lateral limits of the printer chassis.

The printer chassis construction according to the present invention also overcomes problems of differential thermal expansion. In addition it provides a robust structure to which other components may be attached and has the further advantage of being compact.

It will be understood that the above description of the present invention is susceptible to various modifications, changes and adaptations.

What is claimed is:

1. A printer chassis comprising a first structural beam, said first structural beam provided with support means for directly supporting a printer carriage, and two structural sideplate members arranged to be attached to said first beam, said first beam directly attached to each said sideplate member such that said sideplate members are spaced from ends of said first beam so that it extends at both ends beyond said sideplate members, and the chassis comprises one or more further structural beams of the same material as said first beam and extending between said sideplate members.

2. A printer chassis according to claim 1, wherein said first beam is attached to each said sideplate member by means of a plurality of attachment points, each of said attachment points for a sideplate member extending in a straight line.

3. A printer chassis according to claim 1, wherein the printer carriage is supported on slider rod means, and wherein the support means comprises a support structure for supporting the slider rod means for said printer carriage.

4. A printer chassis according to claim 3, wherein said slider rod means comprises two slider rods and each said sideplate member defines a seating for a respective one of said two slider rods, one of said seatings comprising a V-shaped groove, and another of said seatings comprising a flat support surface.

5. A printer chassis according to claim 3, wherein said slider rod means are secured to said support means at spaced intervals in a longitudinal direction by securing members which in a first region restrict relative movement in all directions and which, in at least one second region, permit limited relative movement in the longitudinal direction but restrict relative movement in two mutually-orthogonal directions.

6. A printer chassis according to claim 5, wherein said securing members have shaft portions extending through apertures in said support means and openings in said slider rod means, and wherein said apertures in a first region of said support means are of substantially a same size in said longitudinal direction as a corresponding size of said openings in said slider rod means whereas said apertures in at least one second region of said support means are of increased size in said longitudinal direction relative to the corresponding size of said openings in said slider rod means.

7. A printer chassis according to claim 5, wherein said securing members are provided with resilient biasing means to control a securing force between said slider rod means and said first beam.

8. A printer chassis according to claim 1, wherein each said structural beam comprise a plurality of channels of at least part-circular cross-section, said channels being arranged to align with corresponding apertures in said sideplate members to define self-tapping screw connections.

9. A printer chassis according to claim 1, wherein each said sideplate member has a respective arc member attached to the upper part thereof with a support member connected to and extending between said arc members.

10. A printer apparatus comprising a printer chassis according to claim 1 and at least one printer sub-unit having a plurality of projecting attachment elements, wherein said sideplate members are provided with a plurality of apertures, said apertures being arranged to receive the projecting attachment elements.

11. A printer chassis according to claim 3, wherein said slider rod means includes at least one slider rod, said first structural beam has a longitudinal extent, and wherein the at least one slider rod is positioned in parallel with the longitudinal extent of the first structural beam.

12. A method of assembling a chassis for a printer comprising a first structural beam fabricated from a beam material, said first structural beam providing support for a printer carriage structure, and two structural sideplate members, comprising providing one or more further structural beams of the same beam material as said first structural beam, firmly, precisely and directly fixing said first beam to each sideplate member such that said sideplate members are spaced from ends of said first beam such that said first beam extends at both ends beyond said sideplate members and so as to define a reference for the relative location of the one or more said further structural beams between said sideplate members, attaching each said one or more further structural beams of the same material to said sideplate members using said reference to relatively locate said one or more further structural beams and said sideplate members.

13. A method according to claim 12, wherein said fixing of said first beam comprises attaching said first beam to each said sideplate member by means of a plurality of attachment points, each of said plurality of attachment points for a sideplate member arranged in a straight line.

14. A method according to claim 13, wherein said attachment points define apertures arranged to be attached to the sideplate members by screws.

15. A method according to claim 12, wherein said first beam is located in an upper region of said printer and includes a support structure for supporting slider rod means for a printer carriage.

16. A method according to claim 15, wherein said slider rod means includes at least one slider rod, said first structural beam has a longitudinal extent, and wherein the at least one slider rod is positioned in parallel with the longitudinal extent of the first structural beam.

17. A method according to claim 15 wherein said slider rod means comprises two slider rods and each said sideplate member defines a seating for a respective one of said two slider rods, one of said seatings comprising a V-shaped groove, and the other of said seatings comprising a flat support surface and wherein the method comprises engaging said slider rods with their respective seatings before fixing said first beam to said sideplate members.

18. A method according to claim 12, wherein a said further structural beam is a print beam for supporting a plate defining a print surface the method further comprising, before said print beam is fixed to said sideplate members, attaching said plate to said print beam, said plate have a tongue element at each end, and wherein, to align said print beam relative to each said sideplate member, said tongue element is held against a respective slot therein.

19. A method according to claim 12, wherein said beams are fixed to said sideplate members in order of precision required by the nature of printer functions to be respectively supported, such that the attachment of each beam does not adversely affect an accuracy of attachment of any previously attached beam.

20. A printer apparatus comprising a printer carriage beam, said carriage beam having elongate support means arranged for directly supporting at least one slider rod for mounting a printer carriage, and two structural sideplate members arranged to be attached to said carriage beam, said carriage beam directly attached to each said sideplate member such that said sideplate members are spaced from ends of said carriage beam, wherein said rod and said beam are secured together at spaced intervals in a longitudinal direction by securing members wherein, in a first region, said securing members restrict relative movement in all directions and, in at least one second region, said securing members permit limited relative movement in the longitudinal direction but restrict relative movement in two mutually-orthogonal directions.

21. A printer apparatus according to claim 20, wherein said elongate support means has a longitudinal extent, and wherein the at least one slider rod is positioned in parallel with said longitudinal extent.

22. A printer apparatus according to claim 20, wherein said securing members have shaft portions extending through apertures in said support means and openings in said rod and wherein said apertures in said first region of said support means are of substantially a same size as said openings in said rod whereas said apertures in the or each said second region of said support means are of increased size in said longitudinal direction.

23. A printer apparatus according to claim 20, wherein said securing members are screws with threaded shaft portions and said openings in said rod comprise threaded bores.

24. A printer according to claim 20, wherein said first region is at or adjacent the center of said support means with a said second region being provided adjacent each end thereof.

25. A printer apparatus according to claim 20, wherein said securing members are provided with resilient biasing means to control a securing force between said slider rod and said carriage beam.

26. A printer chassis comprising:

a first structural beam fabricated from a beam material, said first structural beam comprising a carriage rod support structure for fixedly supporting at least one slider rod for a printer carriage along a longitudinal extent of the first structural beam;

first and second structural sideplate members arranged to be attached to said first beam, said first beam directly attached to said first and second structural sideplate members so that said sideplate members are spaced from ends of said first beam so that the first structural beam extends at both ends beyond said sideplate members;

one or more further structural beams of the same beam material as said first beam and extending between said sideplate members.

27. A printer apparatus comprising:

a printer carriage beam, said carriage beam having a support structure arranged for directly supporting at least one slider rod for mounting a printer carriage, and two structural sideplate members arranged to be attached to said carriage beam, said carriage beam directly attached to each said sideplate member such that said sideplate members are spaced from ends of said carriage beam, said at least one slider rod secured by said support structure along a longitudinal extent of the printer carriage beam, said support structure including securing members for securing said rod and said beam together at spaced intervals along the slider rod, and wherein, in a first region, said securing members restrict relative movement in all directions and, in at least one second region, said securing members permit limited relative movement in a longitudinal direction along the longitudinal extent but restrict relative movement in two mutually-orthogonal directions.

* * * * *